US005884838A

United States Patent [19]

Rose

[11] Patent Number: 5,884,838

[45] Date of Patent: Mar. 23, 1999

[54] SLIDING MAIL BOX INDICATOR

[76] Inventor: Bernard Leo Rose, 910 Brownstown Hill, Stoystown, Pa. 15563

[21] Appl. No.: 90,407

[22] Filed: Jun. 4, 1998

[51] Int. Cl.[6] ..... B65D 91/00

[52] U.S. Cl. ..... 232/35; 116/324

[58] Field of Search ..... 232/35, 34, 17, 232/45; D99/29; 116/173, 321, 322, 323, 324

[56] References Cited

U.S. PATENT DOCUMENTS

| | | | |
|---|---|---|---|
| 2,217,310 | 10/1940 | Fatur | 232/35 |
| 3,482,543 | 12/1969 | Guidos | 232/35 |
| 3,498,256 | 3/1970 | Hebal | 232/35 |
| 3,891,139 | 6/1975 | Redling | 232/35 |
| 4,267,793 | 5/1981 | Lane et al. | 116/324 |
| 4,491,268 | 1/1985 | Faulkingham | 232/35 |
| 4,711,391 | 12/1987 | Roge et al. | 232/35 |
| 4,926,786 | 5/1990 | White | 116/324 |
| 5,201,465 | 4/1993 | Limehouse | 232/35 |
| 5,762,264 | 6/1998 | Ginsberg | 232/35 |

*Primary Examiner*—Brian K. Green
*Assistant Examiner*—William L. Miller
*Attorney, Agent, or Firm*—John P. Halvonik

[57] ABSTRACT

A mail box indicator for noting the arrival of mail. The indicator includes a sliding member that has a latch for connection to the door of the mail box. The latch slides through the use of a resilient cord such as bungee and the cord and latch are contained within an enclosed compartment to avoid exposure to the elements. The latch of the sliding member is connected to the latch of the mail box door when the apparatus is set for use. Opening of the mail box will break this connection and cause the sliding member to travel upward and so indicate that mail has arrived.

3 Claims, 1 Drawing Sheet

SLIDING MAIL BOX INDICATOR

BACKGROUND OF THE INVENTION

1. Field of the Invention

The invention relates to the field of mailbox indicators and in particular to an indicator that provides for a signal device that moves upward when the door of the mail box has been opened. The indicator includes a self contained compartment for the sliding of the indicator.

It is believed that such a sliding system that is contained in a somewhat enclosed compartment will function better than similar prior art mail box indicator systems. The sealed compartment will avoid exposure of the inside members to the elements and so prevent the rain, snow etc. from hampering movement of the slide. Use of a colored indicator will enhance the visual perception that the mail has arrived when the sliding member moves upward. The colored indicator also helps enclose the top of the compartment and so prevent exposure of the elements to the inside members of the compartment.

2. Prior Art

While there are devices that indicate that mail has arrived by moving a signal upon the opening of the mail door none of the prior art is believed to have the structural modifications shown in the applicant's invention described herein. The use of an enclosed compartment in connection with a sliding member is believed to be novel and useful.

SUMMARY OF THE INVENTION

A mail box indicator having a sliding latch portion that is detachable to a portion of the front door of a mail box and slides upward when the door of the mail box is opened. The sliding latch is housed within a partially enclosed compartment to prevent exposure of the working elements inside the compartment from wind, rain, snow, etc. The top of the sliding member has a visual indicating means to indicate when the door of the mail box has been opened. The sliding member should be connected to near the top wall of the compartment by a bungee cord or some other resilient member that will urge the sliding member in the upward direction of travel within the compartment. The visual indicator should be sized and shaped so as to cover the open top of the compartment and aid in protecting the interior working members from exposure to the elements. When the door of the mail box is opened this will release the connection of the door latch with the latch of the sliding member and the sliding member will travel upward to indicate that mail has arrived.

It is among the objects of the invention to provide a mail box indicator that will provide a visual cue to the recipient of mail that mail has arrived.

Another objective is to provide mail box indicator that will be able to withstand the elements of wind, rain, snow, etc. when used for a long period of time.

Another object is to provide mail box indicator that will send an indicator in an upward direction when the mail box door has been opened and so alert the recipient that mail has most likely arrived.

Other objectives of the invention will be readily apparent to those skilled in the art once the invention has been described.

DESCRIPTION OF THE PREFERRED EMBODIMENT

Figure 1:
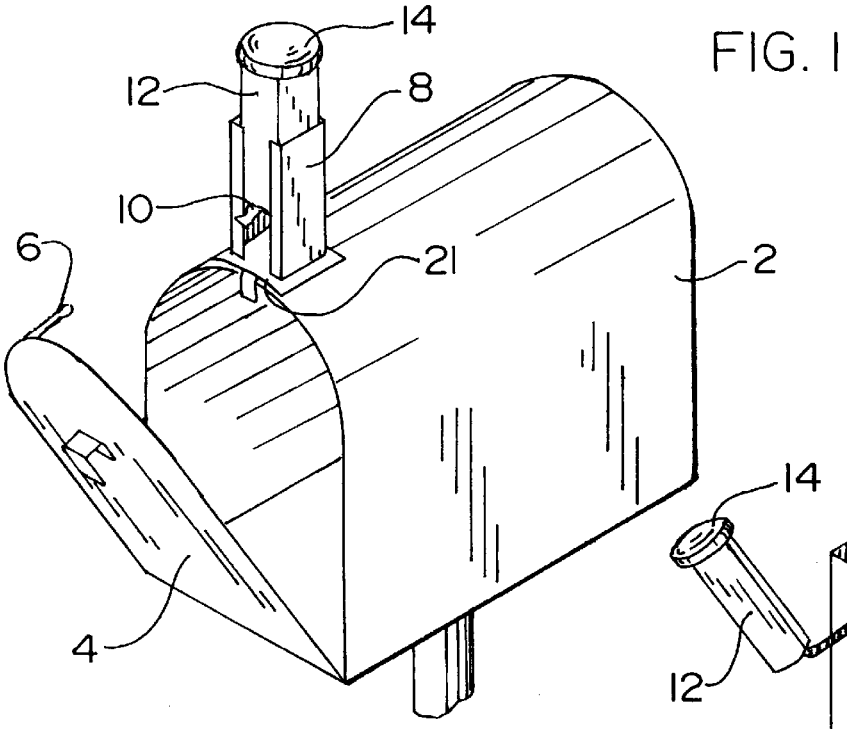
FIG. 1 View of device in connection with a mail box with the indicator in upward position to indicate mail has arrived.
Figure 3:
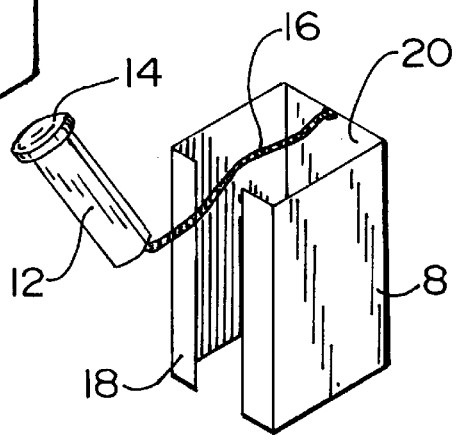
FIG. 3 blow apart view of indicator and stretchable cord.
Figure 2:
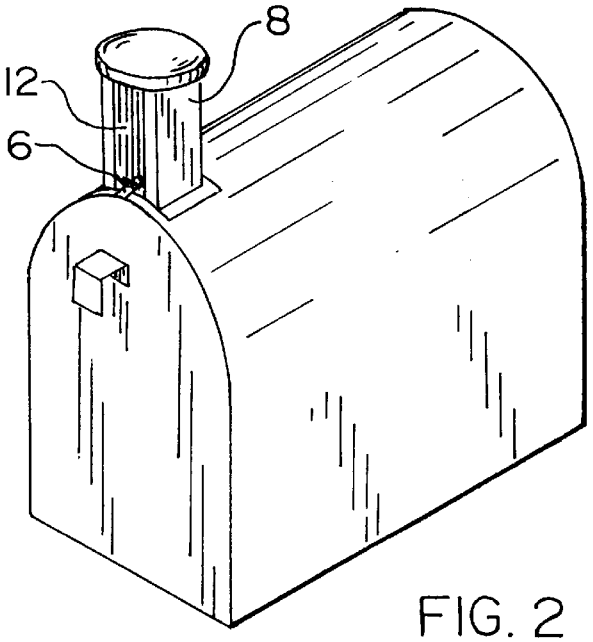
FIG. 2 indicator in connection with mail box when mail box door is shut, prior to arrival of mail.

The invention is shown in some detail in FIG. 3. There is a partially enclosed compartment having a rear wall 20 side walls 8 and two front walls at 18. The side walls are in connection with the front wall to form a partially enclosed area that is open at the top and possibly open at the bottom as well. The front of the compartment is also partially open between the two front walls that form a rectangular shaped opening in the front of the compartment.

The sliding member 12 is also preferably squared-shaped when seen in cross section so that it will fit within the walls of the compartment and be able to slide up and down within the walls. The compartment is designed to enclose the working elements including the sliding member and the resilient member 16 from the elements as much as possible.

The front of the sliding member should have a latch portion 10 that is of shape designed to connect to the latch 6 on the door of the mail box. The compartment and sliding member may be offset slightly from the exact top and center of the mailbox so as to avoid the metal latch portion 21 that is typically permanently connected to the top and center of the mail box.

When in use the compartment and sliding member should be connected to near the top of the mail box. This may be by any state of the art means that will allow the walls of the compartment to be connected to the metal walls of the mail box. The sliding member 12 should be pushed down to its bottom most position so that the latch 10 may form a connection with the door latch 6 of the mail box door. The apparatus is now in position for use. When the mail arrives, the door will have to be opened and this will release the latch 10 from the latch 6 and this in turn will cause the sliding member 12 to travel upward and the recipient will see that the visual indicator at 14 is in the upward position and that this will indicate to him/her that mail has arrived.

The upper portion 14 of the sliding member may be of a distinct color, such as red, in order to further enhance the visual recognition that the indicator is up. The upper portion may be of somewhat larger width and length than the compartment so that the upper portion will serve to cover the open end of the compartment and so prevent rain, wind, etc. from deteriorating the working elements such as the bungee cord, etc.

The resilient member 16 is on the inside of the compartment and is shown in FIG. 3. The resilient member should be attached near the top of the back wall 20 and in connection with the bottom of the sliding member 12. The resilient may be of any material that tends to return to its original size after it has been stretched. It is thought that bungee material or a spring would form an appropriate material for the member as it is inexpensive and will withstand a lot of use in the form of stretching and returning to shape. If a spring is used it should be of the type that returns to its original shape once it is stretched.

When the latch 10 is set in place in connection with the door latch 6 the sliding member 12 will be at the bottom most position of its travel within the compartment. The bungee cord 16 will be somewhat stretched and will thus tend to urge the sliding member upward when the connection of 6 and latch 10 is broken. This will occur, of course, when the door is opened. Typically, that occurs when mail has been delivered. When the connection is broken, the sliding member will travel upward and the recipient of the mail box will see the upper member 14 is in the upward position and so be alerted that mail has arrived. The slack that occurs in the bungee cord will prevent the sliding member from coming entirely out of the compartment when the door is opened.

I claim:

1. A mail box indicator for connection with a latch commonly found on a door of a mail box to indicate when mail has arrived by providing a visual cue when the mail box door has been opened, said indicator comprising a compartment having a front wall, back wall and two side walls connected to said front and back wall so as to partially enclose an area and leave an open area at a top of the compartment; said front wall having a rectangular shaped open portion a sliding member of size and shape so as to fit within said compartment and able to travel in a motion up and down within said compartment so that said side walls will keep said sliding member in close connection with said compartment, said sliding member having a latch member connected to a front of said sliding member, said latch member able to protrude through said rectangular shaped open portion, said latch member of size and shape so as to be able to form a connection with the latch on the door of the mail box when said sliding member is at a lowest point in said traveling motion, a resilient member connected to a bottom of said sliding member and connected adjacent to a top of said back wall, said resilient member made of a stretchable material so as to provide a force urging said sliding member for travel in an upward direction, a visual indicator connected to a top of said sliding member, said visual indicator having a larger width and depth than said sliding member so that said visual indicator will cover the open area at said top of said compartment when said sliding member is at the lowest point of said traveling motion.

2. The mail box indicator of claim 1 where said visual indicator is colored red.

3. The mail box indicator of claim 2 wherein said resilient member is made of bungee material.

* * * * *